US011009266B2

(12) United States Patent
Zha et al.

(10) Patent No.: US 11,009,266 B2
(45) Date of Patent: May 18, 2021

(54) INTEGRATED REFRIGERATION AND AIR CONDITIONING SYSTEM

(71) Applicant: Heatcraft Refrigeration Products LLC, Stone Mountain, GA (US)

(72) Inventors: Shitong Zha, Snellville, GA (US); Masood Ali, Hatchechubbee, AL (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 218 days.

(21) Appl. No.: 15/448,210

(22) Filed: Mar. 2, 2017

(65) Prior Publication Data

US 2018/0252440 A1 Sep. 6, 2018

(51) Int. Cl.
*F25B 5/02* (2006.01)
*F25B 43/00* (2006.01)
(Continued)

(52) U.S. Cl.
CPC ..... *F25B 5/02* (2013.01); *F25B 1/10* (2013.01); *F25B 31/002* (2013.01); *F25B 40/02* (2013.01); *F25B 41/30* (2021.01); *F25B 43/006* (2013.01); *F25B 2341/0012* (2013.01); *F25B 2341/0015* (2013.01); *F25B 2400/075* (2013.01);
(Continued)

(58) Field of Classification Search
CPC .... F25B 5/02; F25B 40/02; F25B 1/10; F25B 31/002; F25B 43/006; F25B 41/06; F25B 2341/00; F25B 2341/001; F25B 2341/0012; F25B 2341/0015; F25B 2341/0016;
(Continued)

(56) References Cited

U.S. PATENT DOCUMENTS 4,420,373 A 12/1983 Egosi
10,352,604 B2 * 7/2019 Zha ..... F25B 41/04
(Continued)

FOREIGN PATENT DOCUMENTS

EP 2754978 A1 7/2014
WO 2016180481 A1 11/2016
WO 2017029011 A1 2/2017

OTHER PUBLICATIONS

European Patent Office, Extended European Search Report, Application No. 18159011.8, dated Aug. 9, 2018, 7 pages.

*Primary Examiner* — Jianying C Atkisson
*Assistant Examiner* — Miguel A Diaz
(74) *Attorney, Agent, or Firm* — Baker Botts L.L.P.

(57) ABSTRACT

A system includes a high side heat exchanger, a flash tank, an air conditioner load, an air conditioner ejector, a refrigeration load, a first compressor, a second compressor, and a vapor ejector. The high side heat exchanger removes heat from a refrigerant. The flash tank stores the refrigerant from the high side heat exchanger. The air conditioner load uses the refrigerant from the flash tank to remove heat from a first space proximate the air conditioner load. The air conditioner ejector pumps the refrigerant from the air conditioner load to the flash tank. The refrigeration load uses the refrigerant from the flash tank to remove heat from a second space proximate the refrigeration load. The first compressor compresses the refrigerant from the refrigeration load. The second compressor compresses a flash gas from the flash tank. The vapor ejector pumps the refrigerant from the refrigeration load to the flash tank.

15 Claims, 4 Drawing Sheets

(51) Int. Cl.

| | |
|---|---|
| ***F25B 31/00*** | (2006.01) |
| ***F25B 1/10*** | (2006.01) |
| ***F25B 40/02*** | (2006.01) |
| ***F25B 41/30*** | (2021.01) |

(52) U.S. Cl.
CPC ..... *F25B 2400/13* (2013.01); *F25B 2400/16* (2013.01); *F25B 2400/23* (2013.01)

(58) Field of Classification Search
CPC ..... F25B 2400/13; F25B 2400/16; F25B 2400/23; F25B 2400/075; F25B 9/08
See application file for complete search history.

(56) References Cited

U.S. PATENT DOCUMENTS

2004/0118144 A1* 6/2004 Hsu ..... F25B 1/10 62/259.2
2013/0125569 A1* 5/2013 Verma ..... F25B 1/10 62/115
2013/0251505 A1* 9/2013 Wang ..... F25B 9/08 415/1
2015/0345835 A1* 12/2015 Martin ..... F25B 7/00 62/238.3
2016/0200170 A1* 7/2016 Kawamoto ..... F25B 40/02 62/157
2016/0238294 A1* 8/2016 Hellmann ..... F25B 43/02
2016/0272047 A1* 9/2016 Gan ..... B60H 1/3223
2017/0074550 A1* 3/2017 Ali ..... F25B 9/008
2017/0159977 A1* 6/2017 Hellmann ..... F25B 1/10
2017/0219263 A1* 8/2017 Schmidt ..... F25B 45/00
2017/0261245 A1* 9/2017 Madsen ..... F25B 41/00
2017/0321941 A1* 11/2017 Fredslund ..... F25B 49/02
2017/0336112 A1* 11/2017 Govekar ..... B60H 1/00585
2017/0343245 A1* 11/2017 Fredslund ..... F25B 9/008
2018/0023847 A1* 1/2018 Nagano ..... F04B 39/04 62/500
2018/0066872 A1* 3/2018 Hellmann ..... F25B 1/10
2018/0119997 A1* 5/2018 Siegert ..... F25B 1/10
2018/0128518 A1* 5/2018 Wilkerson ..... F25B 25/02
2018/0142927 A1* 5/2018 Hellmann ..... F25B 1/10
2018/0187926 A1* 7/2018 Najafifard ..... F25B 9/008
2018/0231284 A1* 8/2018 Prins ..... F25B 49/02
2018/0252440 A1* 9/2018 Zha ..... F25B 5/02
2018/0252442 A1* 9/2018 Zha ..... F25B 5/02
2018/0274821 A1* 9/2018 Lee ..... F25B 1/06
2018/0274823 A1* 9/2018 Rajendiran ..... F25B 1/10
2018/0283750 A1* 10/2018 Prins ..... F25B 9/08
2018/0283754 A1* 10/2018 Prins ..... F25B 41/00
2018/0306491 A1* 10/2018 Saunders ..... F25B 1/10
2018/0320944 A1* 11/2018 Prins ..... F25B 49/022
2019/0072305 A1* 3/2019 Zha ..... F25B 41/04
2019/0353413 A1* 11/2019 Larsen ..... F25B 41/003
2020/0124330 A1* 4/2020 Hayes ..... F25B 5/02
2020/0132345 A1* 4/2020 Sun ..... F25B 49/005
2020/0132351 A1* 4/2020 Zha ..... F25B 1/10

* cited by examiner

Replacement Sheet

INTEGRATED REFRIGERATION AND AIR CONDITIONING SYSTEM

TECHNICAL FIELD

This disclosure relates generally to a cooling system, specifically an integrated refrigeration and air conditioning system.

BACKGROUND

Cooling systems may cycle a refrigerant to cool various spaces. For example, a refrigeration system may cycle refrigerant to cool spaces near or around a refrigeration unit. As another example, an air conditioning system may cycle refrigerant to cool a room.

SUMMARY OF THE DISCLOSURE

According to one embodiment, a system includes a high side heat exchanger, a flash tank, an air conditioner load, an air conditioner ejector, a refrigeration load, a first compressor, a second compressor, and a vapor ejector. The high side heat exchanger removes heat from a refrigerant. The flash tank stores the refrigerant from the high side heat exchanger. The air conditioner load uses the refrigerant from the flash tank to remove heat from a first space proximate the air conditioner load. The air conditioner ejector pumps the refrigerant from the air conditioner load to the flash tank. The refrigeration load uses the refrigerant from the flash tank to remove heat from a second space proximate the refrigeration load. The first compressor compresses the refrigerant from the refrigeration load. The second compressor compresses a flash gas from the flash tank. The vapor ejector pumps the refrigerant from the refrigeration load to the flash tank.

According to another embodiment, a method includes removing heat from a refrigerant using a high side heat exchanger and storing the refrigerant from the high side heat exchanger using a flash tank. The method also includes removing heat from a first space proximate an air conditioner load using the refrigerant from the flash tank and pumping the refrigerant from the air conditioner load to the flash tank using an air conditioner ejector. The method further includes removing heat from a second space proximate the refrigeration load using the refrigerant from the flash tank and compressing the refrigerant from the refrigeration load using a first compressor. The method also includes compressing a flash gas from the flash tank using a second compressor and pumping the refrigerant from the refrigeration load to the flash tank using a vapor ejector.

According to yet another embodiment, a system includes an air conditioner load, an air conditioner ejector, a refrigeration load, a first compressor, a second compressor, and a vapor ejector. The air conditioner load uses a refrigerant from a flash tank to remove heat from a first space proximate the air conditioner load. The air conditioner ejector pumps the refrigerant from the air conditioner load to the flash tank. The refrigeration load uses the refrigerant from the flash tank to remove heat from a second space proximate the refrigeration load. The first compressor compresses the refrigerant from the refrigeration load. The second compressor compresses a flash gas from the flash tank. The vapor ejector pumps the refrigerant from the refrigeration load to the flash tank.

Certain embodiments may provide one or more technical advantages. For example, an embodiment integrates an air conditioning system and a refrigeration system such that certain components of the refrigeration system are shared with the air conditioning system. As another example, an embodiment reduces the amount of space occupied by cooling equipment compared to separate air conditioning and refrigeration systems. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
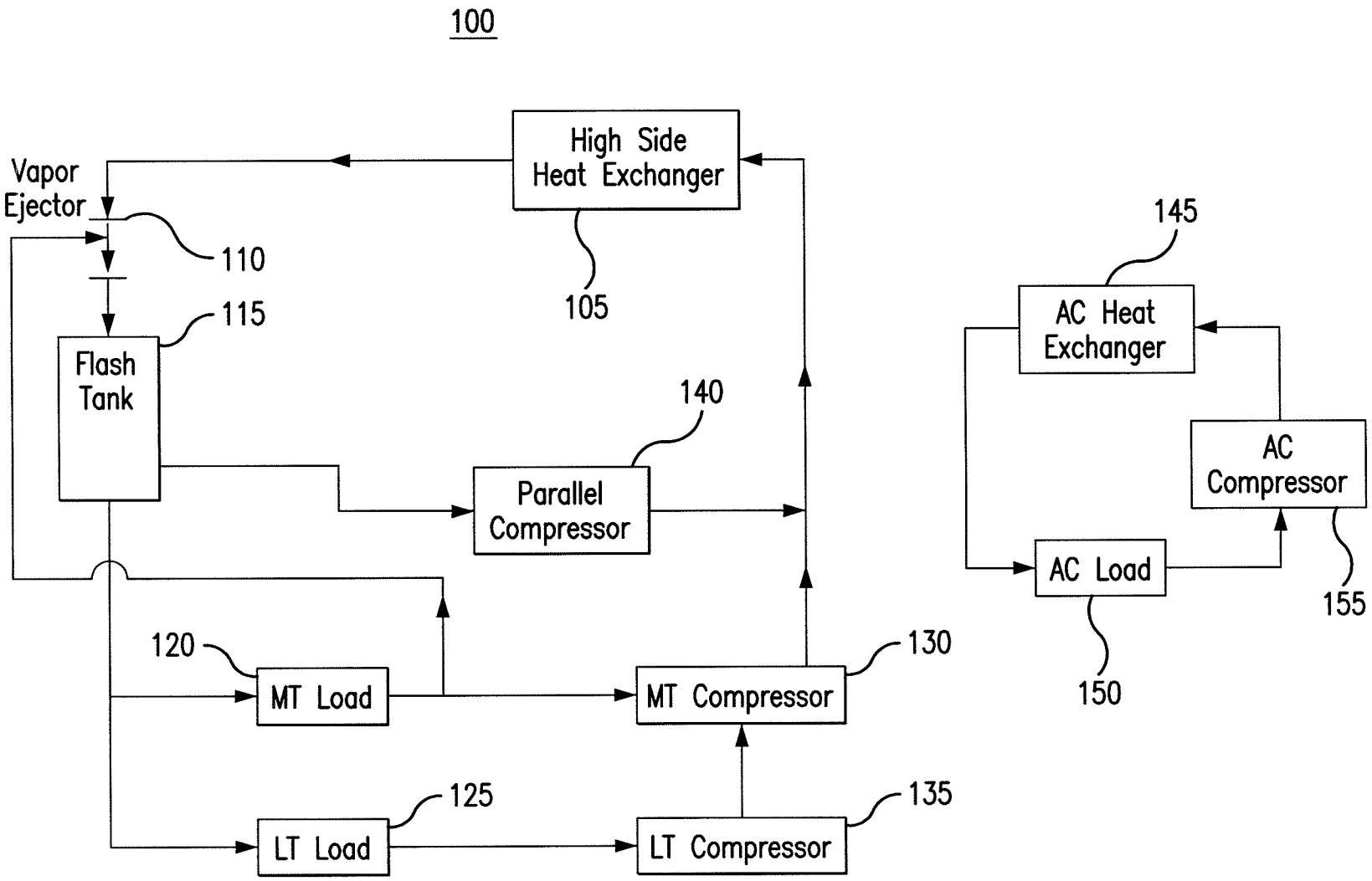
FIG. 1 illustrates an example cooling system with separate refrigeration and air conditioning units.
Figure 2A:
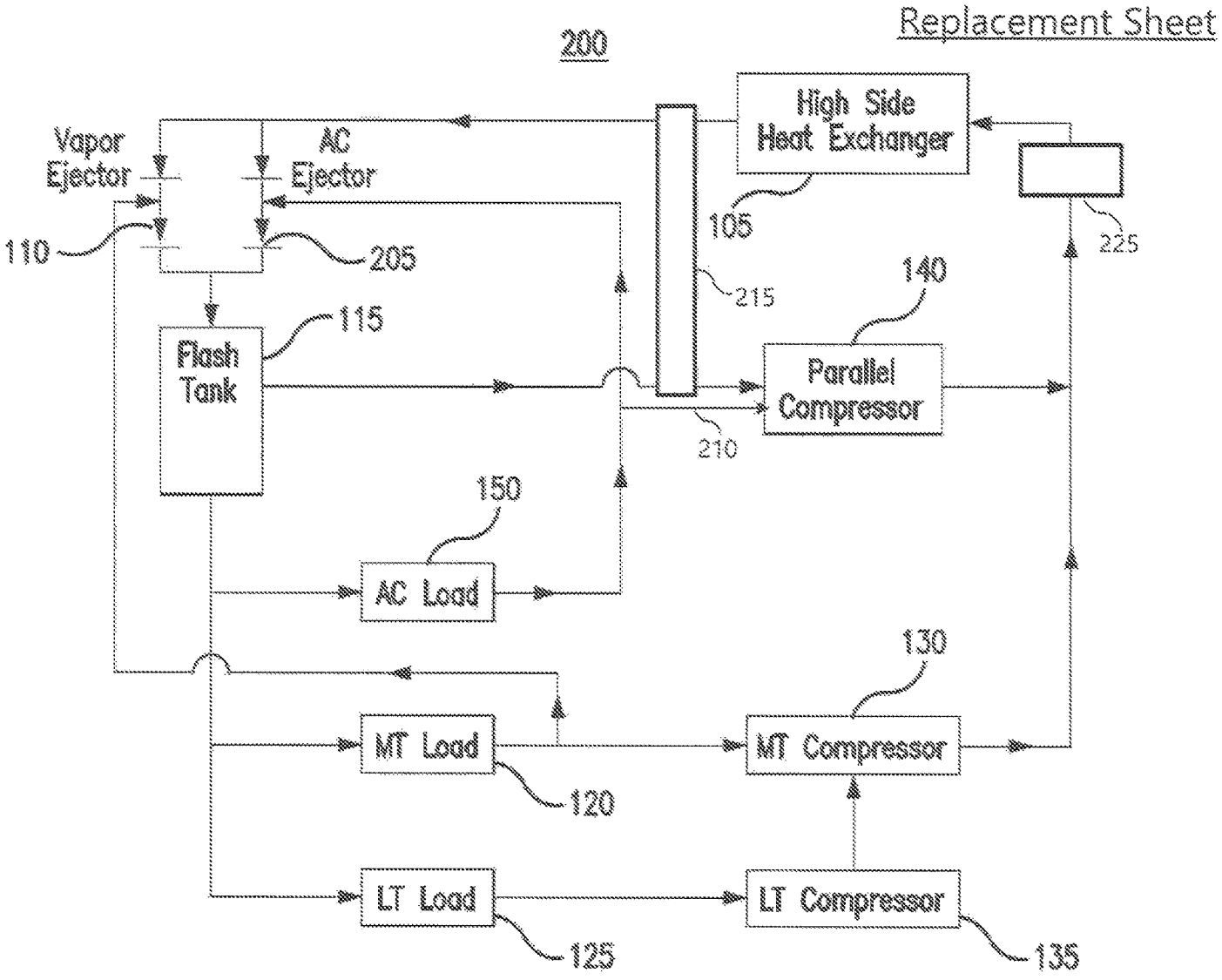
FIGS. 2A and 2B illustrate an example cooling system with integrated refrigeration and air conditioning units.
Figure 2B:
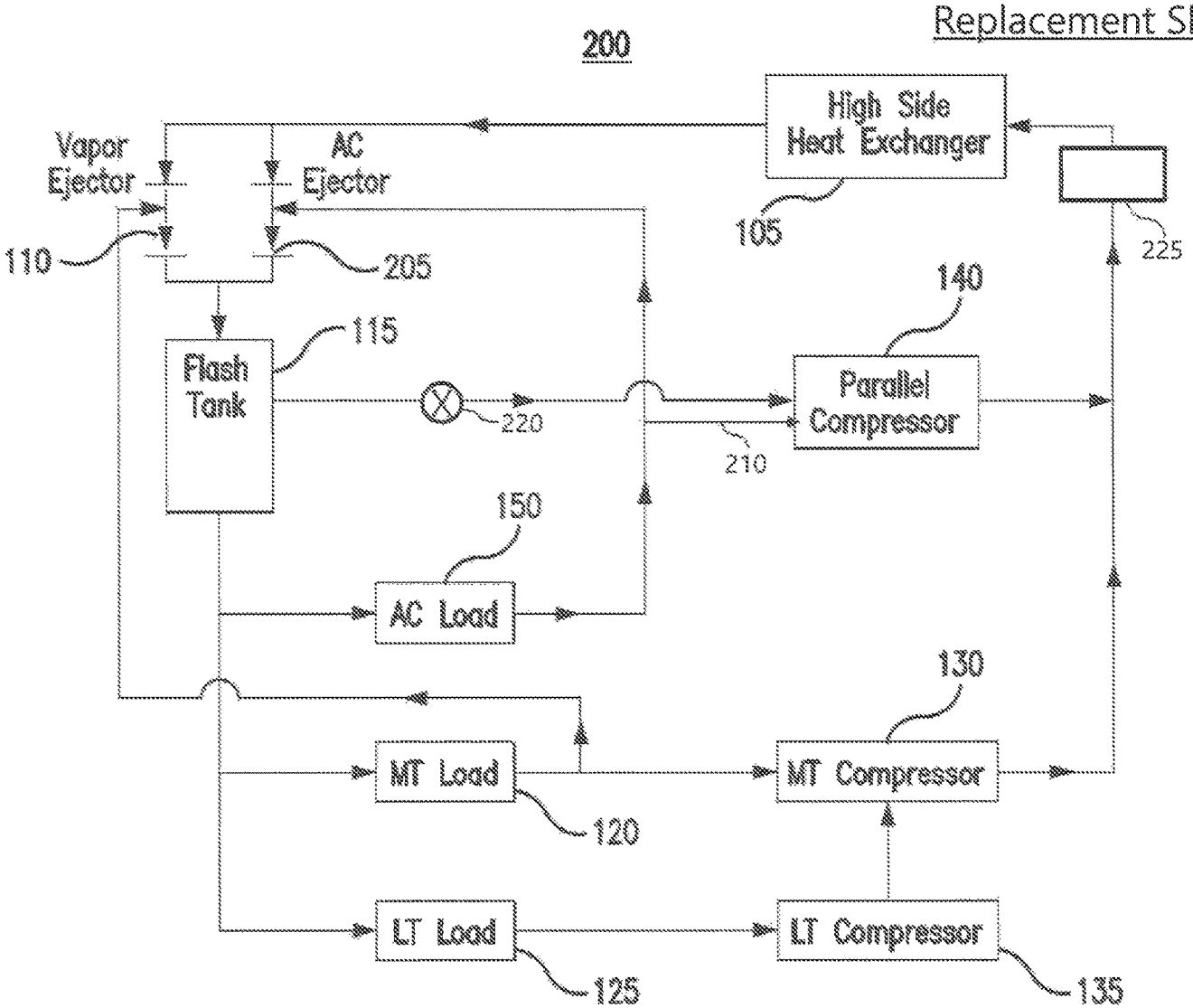
Figure 3:
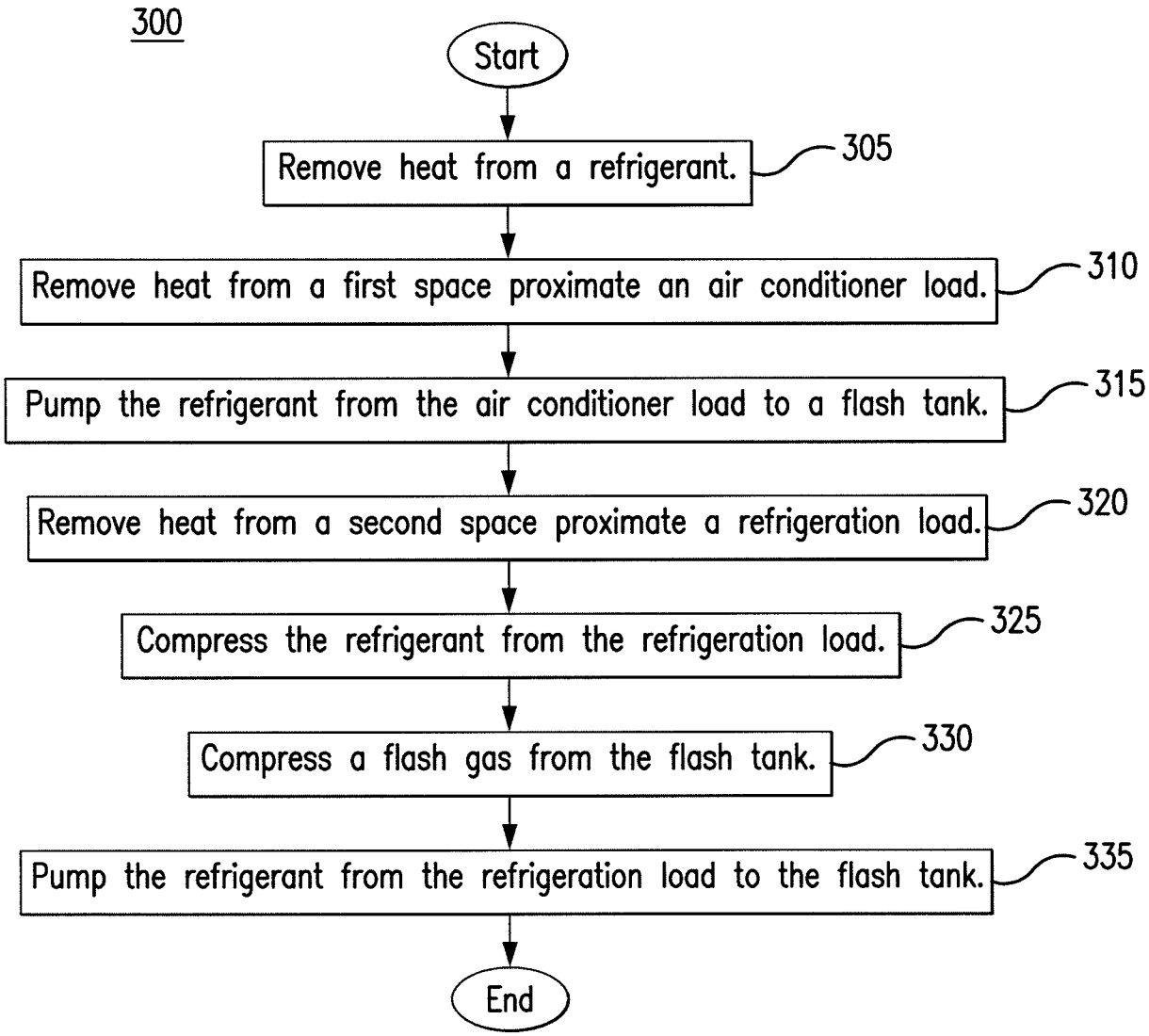
FIG. 3 is a flowchart illustrating a method of operating the example cooling system of FIG. 2.

Embodiments of the present disclosure and its advantages are best understood by referring to FIGS. 1 through 3 of the drawings, like numerals being used for like and corresponding parts of the various drawings.

Cooling systems may cycle a refrigerant to cool various spaces. For example, a refrigeration unit may cycle refrigerant to cool spaces near or around a refrigeration unit. As another example, an air conditioning system may cycle refrigerant to cool a room. In some installations, for example in a store, the refrigeration unit and the air conditioning unit are separate systems. For example, the refrigeration system may use its own equipment and refrigerant and the air conditioning unit may use its own equipment and refrigerant. The two systems may operate simultaneously and separately. However, operating separate refrigeration units and air conditioning units may result in redundant equipment thereby increasing the space needed to install both units. Additionally, operating separate units may result in increased energy costs.

This disclosure contemplates a cooling system with an integrated refrigeration unit and air conditioning unit. The refrigeration unit and air conditioning unit may share certain equipment and operate using a common refrigerant. In certain embodiments, this integrated system may reduce the amount of space needed to install the cooling system. Furthermore, in some embodiments, the integrated system may reduce energy costs over existing cooling systems. This disclosure will describe various cooling systems using FIGS. 1 through 3. FIG. 1 will describe a cooling system with separate refrigeration and air conditioning. FIGS. 2 and 3 will describe a cooling system with integrated refrigeration and air conditioning.

FIG. 1 illustrates an example cooling system 100 with separate refrigeration and air conditioning units. As illustrated in FIG. 1, system 100 includes a high side heat exchanger 105, a vapor ejector 110, a flash tank 115, a medium temperature load 120, a low temperature load 125, a medium temperature compressor 130, a low temperature compressor 135, a parallel compressor 140, an air conditioning heat exchanger 145, an air conditioning load 150, and an air conditioning compressor 155. Operating separate refrigeration units and air conditioning units results in redundant equipment, such as air conditioning heat exchanger 145 and air conditioning compressor 155. As a result, energy costs may be high and the amount of space needed to install both units may also be high.

High side heat exchanger 105 may remove heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Vapor ejector 110 may function as a pump for a refrigerant. For example, vapor ejector 110 may pump refrigerant from medium temperature load 120 back to flash tank 115. In certain embodiments, refrigerant from high side heat exchanger 105 may drive vapor ejector 110.

Flash tank 115 may store refrigerant received from high side heat exchanger 105. This disclosure contemplates flash tank 115 storing refrigerant in any state such as, for example, a liquid state and/or a gaseous state. Refrigerant leaving flash tank 115 is fed to low temperature load 125 and medium temperature load 120. In some embodiments, a flash gas and/or a gaseous refrigerant is released from flash tank 115 to parallel compressor 140. By releasing flash gas, the pressure within flash tank 115 may be reduced.

System 100 may include a low temperature portion and a medium temperature portion. The low temperature portion may operate at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant may flow from flash tank 115 to both the low temperature and medium temperature portions of the refrigeration system. For example, the refrigerant may flow to low temperature load 125 and medium temperature load 120. When the refrigerant reaches low temperature load 125 or medium temperature load 120, the refrigerant removes heat from the air around low temperature load 125 or medium temperature load 120. As a result, the air is cooled. The cooled air may then be circulated such as, for example, by a fan to cool a space such as, for example, a freezer and/or a refrigerated shelf. As refrigerant passes through low temperature load 125 and medium temperature load 120 the refrigerant may change from a liquid state to a gaseous state as it absorbs heat.

Refrigerant may flow from low temperature load 125 and medium temperature load 120 to compressors 130 and 135. This disclosure contemplates system 100 including any number of low temperature compressors 135 and medium temperature compressors 130. Both the low temperature compressor 135 and medium temperature compressor 130 may be configured to increase the pressure of the refrigerant. As a result, the heat in the refrigerant may become concentrated and the refrigerant may become a high pressure gas. Low temperature compressor 135 may compress refrigerant from low temperature load 125 and send the compressed refrigerant to medium temperature compressor 130. Medium temperature compressor 130 may compress refrigerant from low temperature compressor 135 and medium temperature load 120. Medium temperature compressor 130 may then send the compressed refrigerant to high side heat exchanger 105.

Parallel compressor 140 may compress refrigerant (e.g. flash gas and/or gaseous refrigerant) from flash tank 115. As a result, the heat in the refrigerant may become concentrated. Parallel compressor 140 sends the compressed refrigerant to high side heat exchanger 105. The compressed refrigerant may mix with the compressed refrigerant from medium temperature compressor 130.

This disclosure contemplates the refrigeration unit including any number of components in addition to the components illustrated in FIG. 1. For example, the refrigeration unit may include any number of loads and any number of compressors. As another example, the refrigeration unit may include any number of flash tanks.

Air conditioning heat exchanger 145 may operate similarly to high side heat exchanger 105. For example, air conditioning heat exchanger 145 removes heat from a refrigerant cycling in the air conditioning unit. Air conditioning heat exchanger 145 may operate as a condenser, fluid cooler, or gas cooler. In certain configurations, air conditioning heat exchanger 145 is positioned such that heat removed from the refrigerant may be discharged into the air. For example, air conditioning heat exchanger 145 may be positioned on a rooftop so that heat removed from the refrigerant may be discharged into the air. As another example, air conditioning heat exchanger 145 may be positioned external to a building and/or on the side of a building.

Air conditioning load 150 may operate similarly to medium temperature load 120 and low temperature load 125. Air conditioning load 150 may receive refrigerant from air conditioning heat exchanger 145. As the refrigerant passes through air conditioning load 150 (e.g., through coils, plates, tubes, etc.), the refrigerant cools the space proximate air conditioning load 150. Air conditioning load 150 may include a fan that circulates the cooled air to a larger space (e.g., a room) to cool that larger space.

Air conditioning compressor 155 may operate similarly to medium temperature compressor 130 and low temperature compressor 135. Air conditioning compressor 155 may compress refrigerant from air conditioning load 150 and discharge the compressed refrigerant to air conditioning heat exchanger 145. As a result, heat in the refrigerant may become more concentrated and be easier to remove from the refrigerant.

As illustrated in FIG. 1, the refrigeration unit may include high side exchanger 105, vapor ejector 110, flash tank 115, medium temperature load 120, low temperature load 125, medium temperature compressor 130, low temperature compressor 135 and parallel compressor 140. Also as illustrated in FIG. 1, the air conditioning unit may include air conditioning heat exchanger 145, air conditioning load 150 and air conditioning compressor 155. Operating these two separate units may result in redundant components. For example, high side heat exchanger 105 and air conditioning heat exchanger 145 may be redundant. As another example, medium temperature compressor 130, low temperature compressor 135 and parallel compressor 140 may be redundant with air conditioning compressor 155. As a result, operating these two separate systems may result in high energy costs and a large amount of installation space.

FIGS. 2A and 2B illustrate an example cooling system 200 with integrated refrigeration and air conditioner units. As illustrated in FIGS. 2A and 2B, system 200 includes a high side heat exchanger 105, a vapor ejector 110, a flash tank 115, a medium temperature load 120, a low temperature load 125, a medium temperature compressor 130, a low temperature compressor 135, a parallel compressor 140, an air conditioning load 150, and an air conditioning ejector 205. In certain embodiments, system 200 integrates a refrigeration unit with an air conditioning unit thereby reducing the amount of redundant components which may result in reduced energy costs. In some embodiments, integrating the refrigeration unit and the air conditioning unit results in a lower amount of space needed to install the cooling system.

The components of system 200 may be similar to the components of system 100. However, the components of system 200 may be configured differently than the components of system 100 to integrate the air conditioning unit and the refrigeration unit. For example, air conditioning load 150 may be configured to receive refrigerant from flash tank 115. Air conditioning load 150 may use that refrigerant to cool a space proximate air conditioning load 150. The refrigerant from air conditioning load 150 may then be pumped back to flash tank 115 by air conditioning ejector 205. In this manner, air conditioning load 150 may use the same refrigerant as medium temperature load 120 and low temperature load 125. As a result, redundant components such as air conditioning heat exchanger 145 and air conditioning compressor 155 can be removed.

Air conditioning ejector 205 may function similarly to vapor ejector 110. Air conditioning ejector 205 may pump refrigerant from air conditioning load 150 to flash tank 115. Refrigerant from high side heat exchanger 105 may drive air conditioning ejector 205.

In some embodiments, there may be a bypass line 210 between air conditioning load 150 and parallel compressor 140. The bypass line 210 may be used to send refrigerant from air conditioning load 150 to parallel compressor 140 instead of air conditioning ejector 205. It may be necessary to send refrigerant through the bypass line 210 when air conditioning ejector 205 malfunctions and/or when flash tank 115 is too full to hold more refrigerant from air conditioning load 150. In this manner, the bypass line 210 may allow the air conditioning unit to operate even when flash tank 115 cannot receive refrigerant from air conditioning load 150.

In some embodiments, system 200 includes a heat exchanger 215 between flash tank 115 and parallel compressor 140, as illustrated in FIG. 2A. The heat exchanger 215 may transfer heat from the flash gas from flash tank 115 to refrigerant coming from high side heat exchanger 105. In this manner, excess heat may be removed from the flash gas before it reaches parallel compressor 140, As a result, the temperature and/or pressure at parallel compressor 140 may be regulated.

In some embodiments, system 200 includes a valve 220 between flash tank 115 and parallel compressor 140, as illustrated in FIG. 2B. The valve 220 may be used to adjust a pressure of the flash gas from flash tank 115, In this manner, the valve 220 may be used to control the temperature and/or pressure at parallel compressor 140.

In particular embodiments, system 200 includes an oil separator 225 before high side heat exchanger 105. The oil separator 225 may separate oils from the refrigerant from medium temperature compressor 130 and parallel compressor 140. By separating the oil from the refrigerant, it may be easier for high side heat exchanger 105 to remove heat from the refrigerant. Additionally, separating oil from the refrigerant may increase the lifetime and/or efficiency of other components of system 200. The oil separator 225 may separate the oil from the refrigerant and send the refrigerant to high side heat exchanger 105.

This disclosure contemplates system 200 including any number of components. For example, system 200 may include any number of low temperature loads, medium temperature loads, and air conditioning loads. As another example, system 200 may include any number of low temperature compressors, medium temperature compressors, and parallel compressors. As yet another example, system 200 may include any number of high side heat exchangers 105 and flash tanks 115. This disclosure also contemplates cooling system 200 using any appropriate refrigerant. For example, cooling system 200 may use a carbon dioxide refrigerant.

FIG. 3 is a flowchart illustrating a method 300 of operating the example cooling system 200 of FIG. 2. In certain embodiments, various components of system 200 perform method 300. By performing method 300, system 200 may reduce the energy costs for cooling a space in certain embodiments.

High side heat exchanger 105 may begin by removing heat from a refrigerant in step 305. In step 310, air conditioning load 150 may remove heat from a first space proximate the air conditioning load. Then in step 315, air conditioning ejector 205 may pump the refrigerant from the air conditioning load to a flash tank. Medium temperature load 120 and/or low temperature load 125 may then remove heat from a second space proximate medium temperature load 120 and/or low temperature load 125 in step 320. In step 325, medium temperature compressor 130 and/or low temperature compressor 135 may compress the refrigerant from medium temperature load 120 and/or low temperature load 125. Parallel compressor 140 may compress a flash gas from the flash tank in step 330. Then in step 335, vapor ejector 110 may pump refrigerant from medium temperature load 120 and/or low temperature load 125 to the flash tank.

Modifications, additions, or omissions may be made to method 300 depicted in FIG. 3. Method 300 may include more, fewer, or other steps. For example, steps may be performed in parallel or in any suitable order. While discussed as various components of cooling system 200 performing the steps, any suitable component or combination of components of system 200 may perform one or more steps of the method.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a high side heat exchanger configured to remove heat from a refrigerant;

a flash tank configured to store the refrigerant from the high side heat exchanger;

an air conditioner load configured to use the refrigerant from the flash tank to remove heat from a first space proximate the air conditioner load, wherein the air conditioner load is a heat exchanger;

an air conditioner ejector configured to pump the refrigerant from the air conditioner load to the flash tank;

a refrigeration load configured to use the refrigerant from the flash tank to remove heat from a second space proximate the refrigeration load, wherein the refrigeration load is a heat exchanger;

a first compressor configured to compress the refrigerant from the refrigeration load, before the refrigerant from the refrigeration load returns to the flash tank;

a second compressor configured to compress a flash gas from the flash tank, wherein the air conditioner load is further configured to send the refrigerant to the second compressor through a bypass line before the refrigerant returns to the air conditioner ejector when at least one of the air conditioning ejector malfunctions and the flash tank is too full to hold more refrigerant;

a vapor ejector configured to pump the refrigerant from the refrigeration load to the flash tank;

a second refrigeration load configured to use the refrigerant from the flash tank to remove heat from a third space proximate the second refrigeration load, wherein the second refrigeration load is a heat exchanger; and a third compressor configured to compress the refrigerant from the second refrigeration load, wherein the first compressor is further configured to compress the refrigerant from the third compressor before the refrigerant from the third compressor returns to the high side heat exchanger.

2. The system of claim 1, further comprising a heat exchanger configured to exchange heat between the refrigerant from the high side heat exchanger and the flash gas from the flash tank.

3. The system of claim 1, further comprising a valve between the flash tank and the second compressor, the valve configured to adjust a pressure of the flash gas from the flash tank.

4. The system of claim 1, further comprising an oil separator configured to:

receive the refrigerant from the first compressor and the second compressor; and send the refrigerant to the high side heat exchanger.

5. The system of claim 1, wherein the refrigerant from the high side heat exchanger drives the vapor ejector and the air conditioner ejector.

6. A method comprising:

removing heat from a refrigerant using a high side heat exchanger;

storing the refrigerant from the high side heat exchanger using a flash tank;

removing heat from a first space proximate an air conditioner load using the refrigerant from the flash tank, wherein the air conditioner load is a heat exchanger;

pumping the refrigerant from the air conditioner load to the flash tank using an air conditioner ejector;

removing heat from a second space proximate a refrigeration load using the refrigerant from the flash tank, wherein the refrigeration load is a heat exchanger;

compressing the refrigerant from the refrigeration load using a first compressor, before the refrigerant from the refrigeration load returns to the flash tank;

compressing a flash gas from the flash tank using a second compressor;

sending the refrigerant to the second compressor through a bypass line before the refrigerant returns to the air conditioner ejector when at least one of the air conditioning ejector malfunctions and the flash tank is too full to hold more refrigerant;

pumping the refrigerant from the refrigeration load to the flash tank using a vapor ejector;

removing heat from a third space proximate a second refrigeration load using the refrigerant from the flash tank, wherein the second refrigeration load is a heat exchanger;

compressing the refrigerant from the second refrigeration load using a third compressor; and compressing the refrigerant from the third compressor using the first compressor before the refrigerant from the third compressor returns to the high side heat exchanger.

7. The method of claim 6, further comprising exchanging heat between the refrigerant from the high side heat exchanger and the flash gas from the flash tank using a heat exchanger.

8. The method of claim 6, adjusting a pressure of the flash gas from the flash tank using a valve between the flash tank and the second compressor.

9. The method of claim 6, further comprising:

receiving the refrigerant from the first compressor and the second compressor at an oil separator; and sending the refrigerant to the high side heat exchanger using the oil separator.

10. The method of claim 6, wherein the refrigerant from the high side heat exchanger drives the vapor ejector and the air conditioner ejector.

11. A system comprising:

an air conditioner load configured to use a refrigerant from a flash tank to remove heat from a first space proximate the air conditioner load, wherein the air conditioner load is a heat exchanger;

an air conditioner ejector configured to pump the refrigerant from the air conditioner load to the flash tank;

a refrigeration load configured to use the refrigerant from the flash tank to remove heat from a second space proximate the refrigeration load, wherein the refrigeration load is a heat exchanger;

a first compressor configured to compress the refrigerant from the refrigeration load, before the refrigerant from the refrigeration load returns to the flash tank;

a second compressor configured to compress a flash gas from the flash tank, wherein the air conditioner load is further configured to send the refrigerant to the second compressor through a bypass line before the refrigerant returns to the air conditioner ejector when at least one of the air conditioning ejector malfunctions and the flash tank is too full to hold more refrigerant;

a vapor ejector configured to pump the refrigerant from the refrigeration load to the flash tank;

a second refrigeration load configured to use the refrigerant from the flash tank to remove heat from a third space proximate the second refrigeration load, wherein the second refrigeration load is a heat exchanger; and a third compressor configured to compress the refrigerant from the second refrigeration load, wherein the first compressor is further configured to compress the refrigerant from the third compressor before the refrigerant from the third compressor returns to the high side heat exchanger.

12. The system of claim 11, further comprising a heat exchanger configured to exchange heat between the refrigerant and the flash gas from the flash tank.

13. The system of claim 11, further comprising a valve between the flash tank and the second compressor, the valve configured to adjust a pressure of the flash gas from the flash tank.

14. The system of claim 11, further comprising an oil separator configured to:

receive the refrigerant from the first compressor and the second compressor; and send the refrigerant to a high side heat exchanger.

15. The system of claim 11, wherein the refrigerant drives the vapor ejector and the air conditioner ejector.

* * * * *